United States Patent [19]

Andersson

[11] Patent Number: 5,067,311

[45] Date of Patent: Nov. 26, 1991

[54] APPARATUS FOR FORMING PACKAGING MATERIAL INTO A TUBE

[75] Inventor: Helge Andersson, Lund, Sweden

[73] Assignee: Tetra Pak Holdings S.A., Pully, Switzerland

[21] Appl. No.: 605,408

[22] Filed: Oct. 30, 1990

[30] Foreign Application Priority Data

Nov. 7, 1989 [SE] Sweden ..... 8903718

[51] Int. Cl.[5] ..... B65B 9/06

[52] U.S. Cl. ..... 53/551; 493/302; 493/471

[58] Field of Search ..... 53/550, 551, 552, 554, 53/451; 72/224; 198/819; 493/302, 471, 473

[56] References Cited

U.S. PATENT DOCUMENTS

| | | | |
|---|---|---|---|
| 323,002 | 7/1885 | Murphy | 72/224 X |
| 2,762,902 | 9/1956 | Hankin | 72/224 X |
| 2,782,293 | 2/1957 | Sanner | 72/224 X |
| 2,832,271 | 4/1958 | Jarund | 493/302 |
| 2,850,998 | 9/1958 | Williams | 72/224 X |
| 4,641,486 | 2/1987 | Zannoni . | |
| 4,778,046 | 10/1988 | Hashimoto et al. | 198/819 |
| 4,809,844 | 3/1989 | Hashimoto et al. | 198/819 |
| 4,848,063 | 7/1989 | Niske | 53/551 X |

FOREIGN PATENT DOCUMENTS

| | | | |
|---|---|---|---|
| 0271760 | 12/1987 | European Pat. Off. . | |
| 0302413 | 7/1988 | European Pat. Off. . | |
| 177444 | 12/1950 | Switzerland . | |
| 443966 | 7/1984 | Switzerland . | |
| 889538 | 12/1981 | U.S.S.R. . | |
| 795015 | 5/1958 | United Kingdom | 493/302 |

*Primary Examiner*—Robert L. Spruill
*Assistant Examiner*—Daniel B. Moon
*Attorney, Agent, or Firm*—Burns, Doane, Swecker & Mathis

[57] ABSTRACT

An apparatus for forming packaging material into a tubular form includes angularly disposed forming rollers for causing the longitudinal edges of the packaging material to overlap one another so that they can be sealed together. To prevent the packaging material tube from being trapped between adjacent rollers, each of the forming rollers can be provided with one straight roller edge and one chamfered roller edge. The rollers are positioned such that the chamfered roller edge of one forming roller cooperates with the straight roller edge of the adjacent roller, thereby defining a nip directed generally tangentially to an adjacent portion of the packaging material tube. Alternatively, to achieve the same objective, two different types of forming rollers can be employed, one type in which both roller edges are straight and another type in which both roller edges are chamfered. In this latter case, the two types of rollers are alternated with one another.

16 Claims, 3 Drawing Sheets

APPARATUS FOR FORMING PACKAGING MATERIAL INTO A TUBE

FIELD OF THE INVENTION

The present invention relates to an apparatus for forming a web-shaped flexible material sheet into a tubular form by means of rotary forming rollers which define a material aperture.

BACKGROUND OF THE INVENTION

In modern packaging machines for the manufacture of, for example, parallelepipedic packages or cartons for liquid contents such as juice or milk, a web-shaped flexible packaging material is progressively formed into a tubular so form that both longitudinal edges are united and sealed together. After the supply of the desired contents to the packaging material tube, the tube is transversely sealed at even spacing and is severed for the formation of individual packages or cartons which, by possible additional forming processing, may be given the parallelepipedic configuration. The reforming of the originally planar packaging material into tubular form takes place with the aid of forming devices which, inter alia include forming rollers which are annularly disposed about a substantially circular aperture for the packaging material. The forming rollers are freely rotary and together force the packaging material to assume a substantially circular cross-section so that its longitudinal edges may be sealed to one another.

The annularly disposed forming rollers have hitherto normally had conical end surfaces which are located slightly spaced from one another or substantially abut against one another along a line directed from the center of the rollers towards the center of the packaging material tube. In particular in the employment of thin and highly flexible packaging material—as is the case in the manufacture of small carton sizes—it may happen, in such a situation, that the packaging material is entrapped in the nip between the end walls of two mutually adjacent forming rollers so that a longitudinal crease line is formed on the packaging material tube, which occasionally results in rupture of the entire material web or, in any event, gives the subsequent tube on incorrect configuration. With a view to obviating this drawback, attempts have been made in the art to adjust the mutual spacing of the forming rollers so that minimum clearance, or even no clearance occurs between the ends of the forming rollers, but such attempts have enjoyed only limited success and this problem still defies solution in the case of extremely thin packaging material types.

There is, hence, a need in the art to devise, in that type of packaging machine which manufactures packages or cartons from web-shaped flexible material, an apparatus for forming the tube which does not suffer from the above-considered drawbacks.

OBJECTS AND SUMMARY OF THE INVENTION

One object of the present invention is, therefore, to devise an apparatus for forming web-shaped flexible material into tubular form by means of rotary forming rollers which define a material aperture, the apparatus being so designed that the packaging material may freely and without hindrance be formed into a tubular form without longitudinal crease formation occurring and without the packaging material web becoming entrapped or otherwise damaged during the forming process.

A further object of the present invention is to devise an apparatus of the above-mentioned type which, in a conventional manner, operates with freely rotary forming rollers and, consequently, is readily capable of being integrated into existing packaging machines.

Yet a further object of the present invention is to realize an apparatus of the above-mentioned type in which the forming rollers included therein are simple and economical to manufacture.

The above and other objects are attained according to the present invention in that an apparatus of the type described by way of introduction is characterised in that the forming rollers have partly mutually facing end surfaces which substantially abut against one another at the portion of the rollers facing the material aperture, each pair of mutually facing roller edges including one chamfered and one straight roller edge.

By designing, in accordance with the present invention, the forming rollers with cooperating pairs of chamfered and straight roller edges, the direction of the space or nip occurring between the rollers will extend partially tangentially to the packaging material tube and not, as previously, radially. The rollers no longer "grasp hold of" the tube material but instead guide the tube material down through the tube forming apparatus without crease formation or other damage. This effect may be achieved in two different ways, viz. either in that each roller has one chamfered and one straight end edge, or in that every second roller has chamfered edges and every other roller has straight edges. Whichever option is chosen may, for example, be determined by the size of the apparatus as a whole or by particular requirements, the important feature simply being that the above-mentioned angle is retained.

BRIEF DESCRIPTION OF THE ACCOMPANYING DRAWINGS

One preferred embodiment of the apparatus according to the present invention will now be described in greater detail with particular reference to the accompanying, schematic Drawings in which like elements bear like reference numerals and wherein.

DESCRIPTION OF PREFERRED EMBODIMENT

Figure 1:
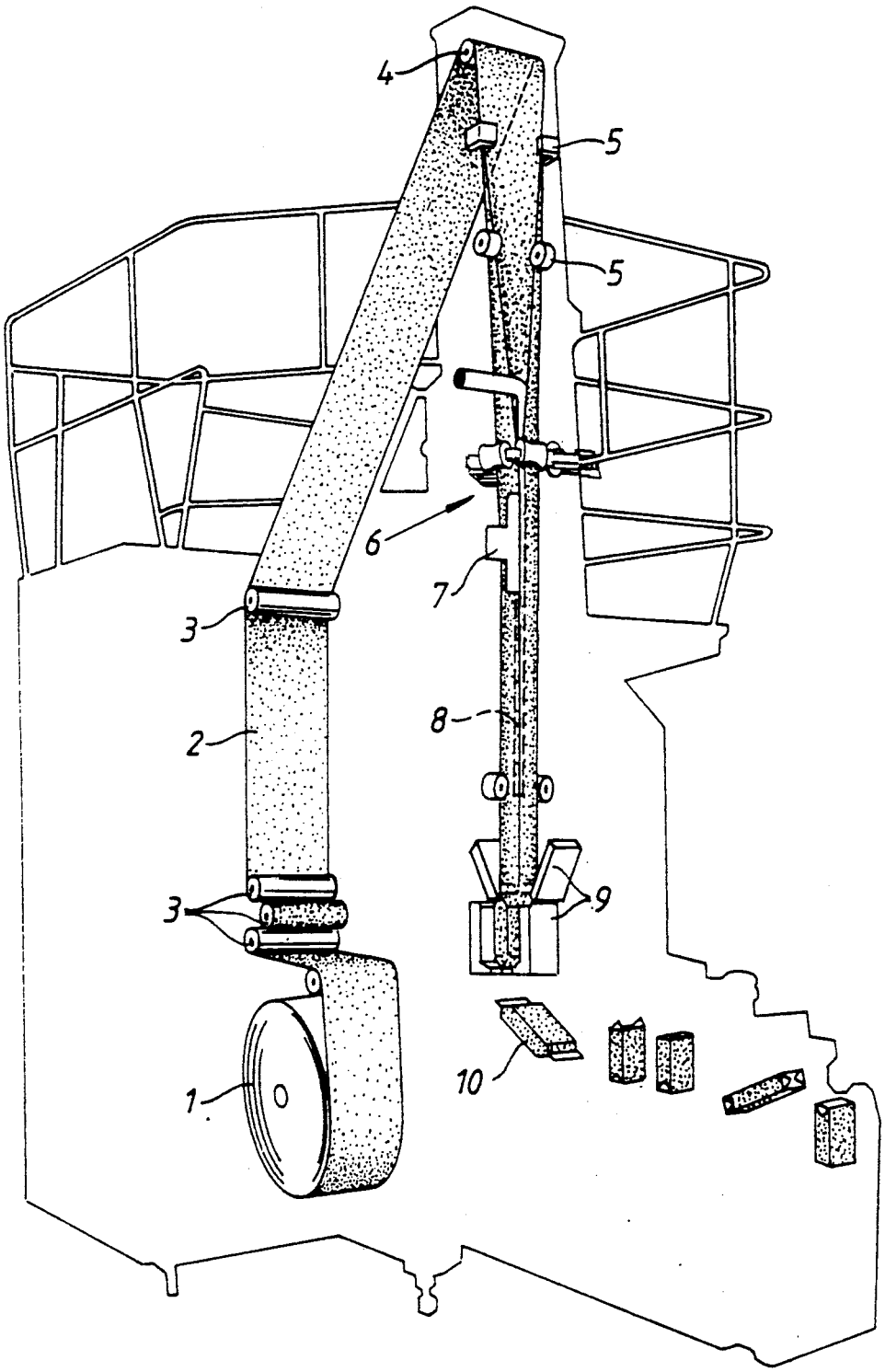
FIG. 1 is a perspective view illustrating some of the features of the apparatus for forming a packaging material web into individual packages or cartons in a packaging machine.

The apparatus according to the present invention is applicable to all types of packaging machines which manufacture packages or cartons by forming a web-shaped flexible packaging material into tubular or cylindrical form. The progressive forming and processing of a packaging material web during the manufacture of parallelepipedic packages or cartons of known type are illustrated in FIG. 1, in which the outer contours of a prior art packaging machine are illustrated. This machine is supplied with flexible, web-shaped packaging material in the form of a reel 1, from which the packaging material web 2 is unwound and fed substantially upwardly through the packaging machine with the aid of guide rollers 3 of known type. At the uppermost region of the machine, the packaging material web 2 passes over a bending roller 4 and is thereafter guided substantially vertically downwards through the packaging machine with the aid of various types of forming devices 5 and a tube forming apparatus 6 according to the invention. By means of the tube forming apparatus 6, the packaging material web is folded such that its two longitudinal edges overlap one another and may be sealed with the aid of a longitudinal sealing device 7 which, in the simplest case when the packaging material web is coated with thermoplastic material, may consist of a hot air nozzle. A filler pipe 8 extends down concentrically in the tube, the pipe extending in through the upper open end of the tube and discharging in the tube immediately above the point where the tube is formed into individual packages or cartons. This is effected by means of forming and sealing jaws 9 which cooperate pairwise for compressing together and transversely sealing the packaging material tube. The forming and sealing jaws 9 also help, to a certain extent, the forming of the packaging material tube which, thereafter, is severed transversely in the sealing zones so that individual packages or cartons 10 are created which, by possible additional forming work, may be given, for example, the illustrated substantially parallelepipedic configuration.

Figure 2:
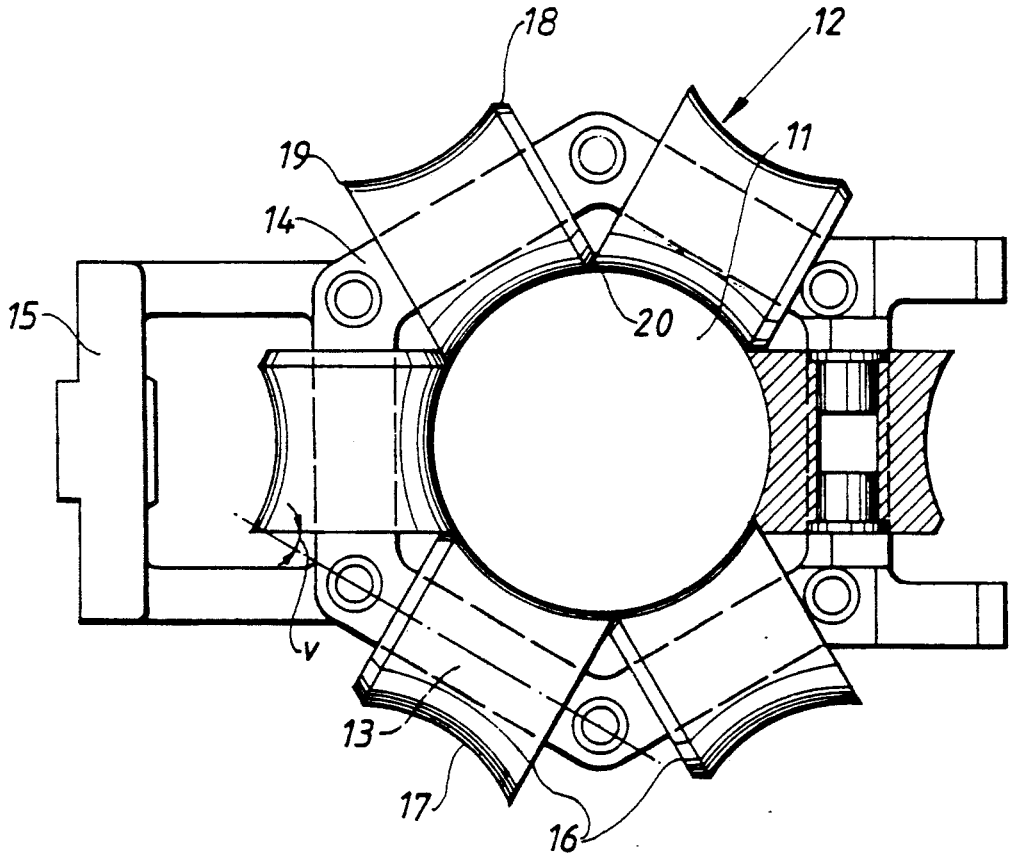
FIG. 2 is a top view, partly in section, one preferred embodiment of the tube forming apparatus according to the present invention.

The tube forming apparatus 6 according to the present invention, disposed in the above-described, prior art packaging machine or a similar packaging machine, is illustrated in greater detail in FIG. 2, in which the apparatus is viewed straight from above, i.e. substantially seen from the position of the bending roller 4 (FIG. 1). A material aperture 11 is disposed centrally in the apparatus according to the present invention. The aperture is substantially circular and during the forming process the packaging material is displaced substantially continuously downwards through the aperture 11 and through the packaging machine. The circular material aperture 11 is formed by a number of forming rollers 12 which, in order to impart to the material aperture 11 its desired circular configuration, are of progressively increasing diameter towards their end surfaces. The forming rollers 12 are freely rotatably suspended about shafts 13 which, in the illustrated number of forming rollers, six in all, have a mutual angle of 120°. The shafts 13 are annularly disposed in a bracket 14 which, by means of an anchorage 15, is rigidly connected to the frame of the packaging machine. Each forming roller 12 includes two substantially planar end surfaces 16 and a working surface 17 disposed between the end surfaces and engaging the packaging material. Between each respective end surface 16 and the working surface 17, each forming roller 12 displays one chamfered edge 18 and one straight edge 19 which, because of the mutual spacing of two adjacent forming rollers, substantially abut linearly with one another and form a nip 20 along a rolling radius extending towards the packaging material tube. While direct abutment would be desirable, this is normally not possible for practical reasons (tolerances, wear etc.), but instead the nip is set with the smallest possible clearance, for example between 0.1 and 0.5 mm.

Figure 3:
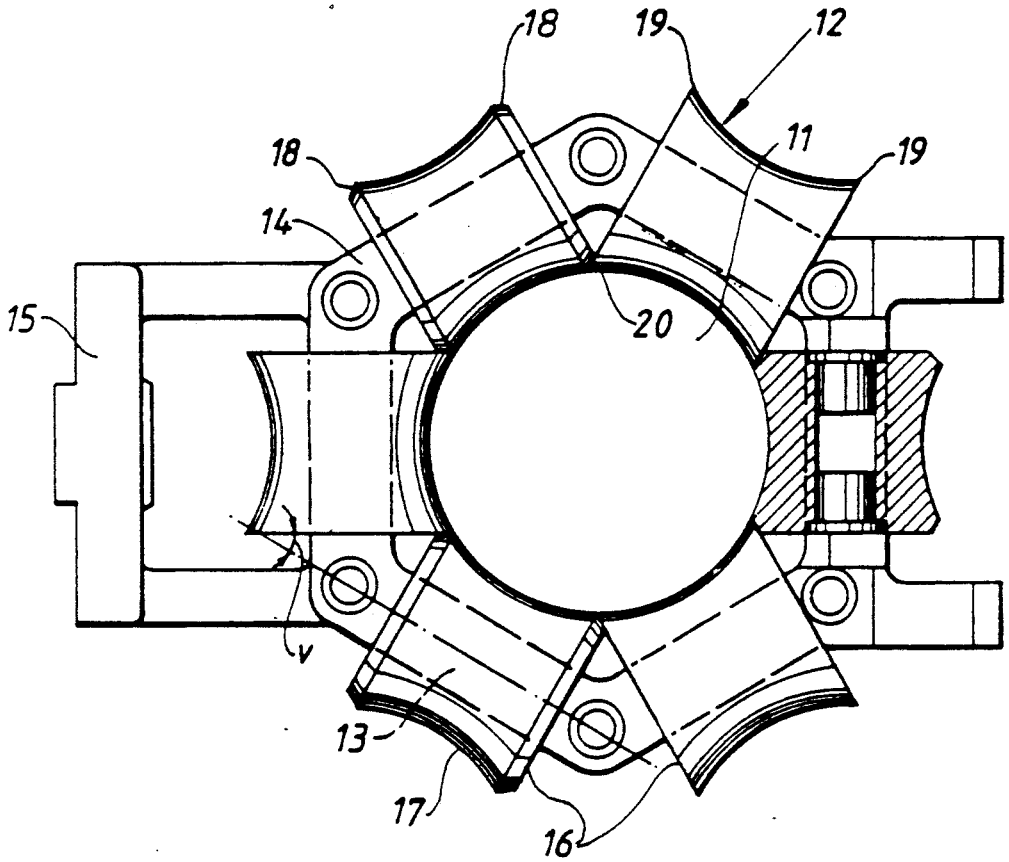
FIG. 3 is a top view, partly in section, of another preferred embodiment of the tube forming apparatus according to the present invention.

In the illustrated embodiment, each forming roller 12 has one chamfered edge and one straight edge, and the rollers 12 are turned in such a manner that each straight edge 19 cooperates with an adjacent chamfered edge 18 on the neighboring roller. However, it is also possible to provide the forming apparatus according to the present invention with two different types of forming rollers, namely one roller type with chamfered edges at both ends and one roller type with straight edges at both ends, which, in such instance, are placed alternatingly so that, also here, one chamfered edge meets and cooperates with a neighboring straight edge. This latter version of the present invention, illustrated in FIG. 3, may be advantageous in packaging material tubes of very small diameter, but may also be preferred for other reasons.

Each chamfered roller edge 18 should, where it borders with the packaging material tube, extend towards the surface of the packaging material tube as tangentially as possible so as to avoid the risk that the packaging material tube becomes entrapped between the rollers, and preferably each chamfered roller edge is at an angle to the centre axis of the roller which is equal to the angle v indicated in FIG. 2 between the end surface of an adjacent roller and the above-mentioned centre axis 13 (60° in the illustrated embodiment of the present invention). As a result of this design, the nip 20 between one chamfered edge 18 and the end surface 16 of an adjacent forming roller 12 will extend partly tangentially to the packaging material tube, which has proved in practice to greatly reduce the risk that the packaging material will be entrapped by the nip and clenched under longitudinal crease formation during the downward displacement of the packaging material through the tube forming apparatus.

On operation of the apparatus according to the present invention, the packaging material web 2 is progressively displaced by the packaging machine from the reel 1, via the guide rollers 3 and bending roller 4 and, thereafter, during formation into tubular form, substantially vertically downwards through the packaging machine to the forming and sealing jaws 9. When the packaging material approaches the tube forming apparatus according to the invention, it first passes the forming devices 5 which, as a preparatory measure for the tube formation, fold both of the longitudinal edges of the packaging material web slightly towards one another. When the packaging material web 2 reaches the tube forming apparatus 6 according to the invention, it passes through the substantially circular material aperture 11 between the working surfaces 17 of the forming rollers 12 and is thereby given a substantially circular cross-sectional configuration with partially overlapping longitudinal edges which are sealed to one another by means of the sealing device 7. Since the nip 20 between the mutually adjacent forming rollers 12 does not extend radially to the centre of the material aperture 11 but substantially tangentially to the surface of the packaging material 2, the packaging material will be guided down through the material aperture 11 without being nipped between the rollers 12 and without being damaged or otherwise disrupted on its passage. In practice, this has proved to function most satisfactorily even in the case of extremely thin packaging material of the type which is employed for very small packages or cartons.

While this invention has been illustrated and described in accordance with a preferred embodiment, it is recognized that variations and changes may be made and equivalents employed herein without departing from the invention as set forth in the claims.

What is claimed is:

1. An apparatus for forming a web of packaging material into a hollow configuration comprising: a plurality of forming rollers arranged adjacent to one another to define a material aperture therebetween through which the web is to be conveyed in order to be formed into a hollow configuration, each of said forming rollers having a longitudinal axis and oppositely positioned end surfaces extending substantially radially of said longitudinal axis, each of said forming rollers also having a working surface disposed between the end surfaces and a roller edge positioned between the working surface and each end surface, at least one pair of adjacent forming rollers including a first forming roller having one roller edge in which the working surface and one end surface are separated by a chamfered portion and a second forming roller having one roller edge in which the working surface and one end surface intersect directly, the first forming roller being positioned with respect to the second forming roller such that the chamfered portion of the first forming roller faces said one end surface of the second forming roller.

2. The apparatus according to claim 1, wherein the chamfered roller edge on the first forming roller is slightly spaced from the one end surface on the second roller to form a nip between the first and second rollers.

3. The apparatus according to claim 2, wherein said first and second forming rollers are rotatable about a rotational axis, the chamfered roller edge on the first forming roller forming an angle with the rotational axis of the first forming roller that is substantially equal to the angle formed between the rotational axis of the first forming roller and the plane in which lies the facing end surface of the second forming roller.

4. The apparatus according to claim 1, wherein the roller edge positioned opposite the one roller edge on the first forming roller is defined by the working surface and the opposite end surface intersecting directly, and wherein the roller edge positioned opposite the one roller edge on the second forming roller is defined by the working surface and the opposite end surface being separated by a chamfered portion.

5. The apparatus according to claim 1, wherein the roller edge positioned opposite the one roller edge on the first forming roller is defined by the working surface and the opposite end surface being separated by a chamfered portion, and wherein the roller edge positioned opposite the one roller edge on the second forming roller is defined by the working surface and the opposite end surface intersecting directly.

6. The apparatus according to claim 1, wherein said plurality of rollers are mounted on a bracket to form an annular arrangement of forming rollers.

7. The apparatus according to claim 1, wherein said plurality of forming rollers are freely rotatable.

8. The apparatus according to claim 1, wherein the working surface of each forming roller increases in diameter toward the end edges.

9. The apparatus according to claim 1, wherein said material aperture is substantially circular.

10. The apparatus according to claim 1, wherein the end surfaces of each forming roller are substantially planar.

11. The apparatus according to claim 1, wherein each pair of adjacent forming rollers includes a first forming roller having one roller edge in which the working surface and one end surface are separated by a chamfered portion and a second roller having one roller edge in which the working surface and one end surface intersect directly.

12. An apparatus for forming a web of packaging material into a hollow configuration comprising: a plurality of forming rollers mounted adjacent to one another on a bracket, said plurality of forming rollers arranged to define a material aperture therebetween through which the web is to be conveyed in order to be formed into a hollow configuration, each of said forming rollers having oppositely positioned end surfaces and a longitudinal axis, a working surface disposed between the end surfaces and a roller edge positioned between the working surface and each end surface, said forming rollers being freely rotatable about their respective longitudinal axes, each pair of adjacent forming rollers including a first forming roller having one roller edge in which the working surface and one end surface are separated by a chamfered portion and a second roller having one end surface which faces the chamfered portion, said chamfered portion forming an angle with the longitudinal axis of the first roller that is substantially equal to the angle which the longitudinal axis of the first roller forms with the facing end surface of the second forming roller.

13. The apparatus according to claim 12, wherein the roller edge opposite the one roller edge on the first forming roller is defined by the working surface and the opposite end surface intersecting directly, one of the roller edges of the second forming roller being defined by the working surface and one of the end surfaces being separated by a chamfered portion and the other roller edge of the second forming roller being defined by the working surface and the opposite end surface intersecting directly, the first forming roller being positioned with respect to the second forming roller such that the chamfered portion of the first forming roller faces the one end surface on the second forming roller.

14. The apparatus according to claim 12, wherein the roller edge opposite the one roller edge on the first forming roller is defined by the working surface and the opposite end surface being separated by a chamfered portion and wherein both roller edges of the second forming roller are defined by the working surface intersecting directly with the end surfaces.

15. A packaging machine for manufacturing individual packages from a web of packaging material, comprising:

forming means for forming the web into a tubular configuration;

guide rollers for guiding the web of packaging material to the forming means; and means positioned downstream of the forming means for dividing the tubularly configured packaging material into individual packages, said forming means including a plurality of forming rollers mounted adjacent to one another on a bracket, said plurality of forming rollers being angularly arranged to define a material aperture therebetween through which the web is to be conveyed in order to be formed into a tubular configuration, each of said forming rollers having oppositely positioned first and second end surfaces and a working surface disposed between the first and second end surfaces, each of said rollers having one roller edge in which the first end surface and the working surface are separated by a chamfered portion, each of said rollers also having another oppositely positioned roller edge in which the second end surface and the working surface intersect directly, said forming rollers being arranged such that the chamfered portion of substantially all of the forming rollers faces and is positioned adjacent to the second end surface of the adjacent forming roller.

16. A packaging machine for manufacturing individual packages from a web of packaging material, comprising:

forming means for forming the web into a tubular configuration;

guide rollers for guiding the web of packaging material to the forming means; and means positioned downstream of the forming means for dividing the tubularly configured packaging material into individual packages, said forming means including a plurality of forming rollers mounted adjacent to one another on a bracket, said plurality of forming rollers being angularly arranged to define a material aperture therebetween through which the web is to be conveyed in order to be formed into a tubular configuration, said plurality of forming rollers including first forming rollers and second forming rollers, each of said first and second forming rollers having oppositely positioned end surfaces and a working surface disposed between the end surfaces, said first forming rollers having a roller edge positioned between the working surface and each end surface, both roller edges of the first forming rollers being defined by the working surface being separated from each of the end surfaces by a chamfered portion, the working surface of each second forming roller directly intersecting both end surfaces of the respective second forming roller to define oppositely positioned roller edges, said plurality of forming rollers being arranged such that the first and second rollers alternate with one another.

* * * * *